US006641312B1

(12) United States Patent
Chang et al.

(10) Patent No.: US 6,641,312 B1
(45) Date of Patent: Nov. 4, 2003

(54) PRINTER AND METHOD FOR EXECUTING A PRINT JOB AND STORING PRINT USAGE INFORMATION

(75) Inventors: Sook Shin Chang, Singapore (SG); Mathew John, Singapore (SG); Siow Kiat Tan, Singapore (SG)

(73) Assignee: Hewlett-Packard Development Company, LP., Houston, TX (US)

( * ) Notice: Subject to any disclaimer, the term of this patent is extended or adjusted under 35 U.S.C. 154(b) by 171 days.

(21) Appl. No.: 09/703,509

(22) Filed: Oct. 31, 2000

(51) Int. Cl.[7] ..... B41J 11/44
(52) U.S. Cl. ..... 400/76; 400/70; 400/61
(58) Field of Search ..... 400/76, 70, 61; 709/321

(56) References Cited

U.S. PATENT DOCUMENTS 5,023,813 A * 6/1991 Brown, III ..... 358/1.17
5,794,094 A * 8/1998 Boockholdt et al. ..... 399/27
5,917,511 A * 6/1999 Ueda ..... 347/14
5,995,774 A * 11/1999 Applegate et al. ..... 399/27
6,148,346 A * 11/2000 Hanson ..... 709/321
6,216,113 B1 * 4/2001 Aikens et al. ..... 399/79
6,233,408 B1 * 5/2001 Allen ..... 399/15
6,275,664 B1 * 8/2001 Wolf et al. ..... 399/23
6,313,921 B1 * 11/2001 Kadowaki ..... 358/1.1
6,317,848 B1 * 11/2001 Sorens et al. ..... 710/19
6,390,590 B1 * 5/2002 Hansburg ..... 347/19

FOREIGN PATENT DOCUMENTS

JP 11320983 A * 11/1999 ..... B41J/5/30

* cited by examiner

*Primary Examiner*—Charles H. Nolan, Jr.

(57) ABSTRACT

According to the present invention, print usage information, for example user information and/or application information, is stored centrally in a non-volatile memory of the printer.

25 Claims, 2 Drawing Sheets

HP Deskjet 1220C NVM Content

```
       00 01 02 03 04 05 06 07 08 09 0A 0B 0C 0D 0E 0F 10 11 12 13 14 15 16 17 18 19 1A 1B 1C 1D 1E 1F
       -- -- -- -- -- -- -- -- -- -- -- -- -- -- -- -- -- -- -- -- -- -- -- -- -- -- -- -- -- -- -- --
0000:  90 02 04 02 10 04 31 06 00 03 1F 02 08 1F 02 37 0F 01 0F 0F 00 05 0F 02 D2 0E 00 05 1F 01 24 0F   .......1.........7............. $.
0020:  0C 0C 0F 03 1A 0F 00 02 1F 01 09 1F 08 37 0F 04 60 0F 00 7C 0F DS 14 00 2E 9F C8 SD 00 2E 9F C8   .............7..`..|.......I....
0040:  5D 00 01 01 00 01 00 01 00 7D 11 00 01 01 00 01 00 01 00 7D 11 53 47 39 42 4F 31 33 30 30 4B 4F   I........}........}.SG9BO1300K0
0060:  4B 44 65 73 6B 4A 65 74 20 31 32 32 30 43 00 00 00 00 00 00 00 00 00 00 48 65 77 6C 65 74 74   KDeskJet 1220C.............Hewlett
0080:  2D 50 61 63 6B 61 72 64 03 F0 12 02 BE BE 00 04 B0 00 02 00 01 55 02 D0 00 04 B0 02 58 C3 48 03   -Packard.............U........X.H.
00A0:  27 21 00 F4 39 1F 04 08 12 FD FF FF FF 04 08 13 FE FF FF FF 04 08 14 28 00 00 00 00 00 00 00 00   '!..9....................{.........
00C0:  00 00 00 00 00 00 00 00 00 00 00 00 00 00 00 00 00 00 00 00 00 00 00 00 00 00 00 00 00 00 00 00   ................................
00ED:  00 00 00 00 00 00 00 00 00 00 00 00 00 00 00 00 00 00 00 00 00 00 00 00 00 00 00 00 00 00 00 00   ................................
0100:  00 00 00 00 00 00 00 00 00 00 00 00 00 00 00 00 00 00 00 00 00 00 00 00 00 00 00 00 00 00 00 00   ................................
0120:  00 00 00 00 00 00 00 00 00 00 00 00 00 00 00 00 00 00 00 00 00 00 00 00 00 00 00 00 00 00 00 00   ................................
0140:  00 00 00 00 00 00 00 00 00 00 00 00 00 00 00 00 00 00 00 00 00 00 00 00 00 00 00 00 00 00 00 00   ................................
0160:  00 00 00 00 00 00 00 00 00 00 00 00 00 00 00 00 00 00 00 00 00 00 00 00 CB D2 01 00 00 01 4F A4   ................................
0180:  7D 01 00 00 01 4F 7D 07 03 00 74 02 DD 00 58 00 14 00 16 00 00 12 14 00 41 00 00 00 00 00 00 01   }....O}...t...X..........A.......
01A0:  2F 00 D3 FF FF FF FF 00 00 08 35 6C E9 EA 0C 10 0A 11 15 FF 0B F7 0D FB 12 FB 4C A0 31 39 39 39   /.......5l.................L.1999
01C0:  31 32 31 39 31 36 33 37 5A 00 00 00 00 00 00 FF FF 01 00 08 38 4C E8 2D 00 1B 0B 40 00 1B 0B 40   12191637Z.........8L.-....@...@
01E0:  08 27 20 31 36 06 64 19 00 1E 83 08 27 20 31 36 06 64 19 00 1E 83 01 1F 00 75 01 19 01 03 0F 0F   .' 16.d.....'.16.d..........u.....
0200:  2C 88 2A F8 01 03 2A F8 26 47 00 03 96 05 F0 FD 00 03 CE 09 81 CD 00 00 DF 00 00 C1 01 00 00 00   ,.*...*.&G..................
0220:  01 00 00 00 02 00 00 00 04 00 00 00 00 82 7B 12 1E E1 36 27 40 ED 08 18 0C FF C7 35 E4 61 87 03   ..............{...6'@........5.a..
0240:  C5 A5 2F 23 A9 0F 1F 12 91 38 00 D6 13 0F 2B 5D 12 1E E1 36 29 67 B1 A8 1A 09 FF 5F 38 BB F5 03   ../#.....8...+]...6)g.........._8......
0260:  C5 A5 2F 26 7B 2C B5 14 E5 14 6A 15 6B 59 AF 00 15 E4 86 00 27 40 ED 00 1B 0D 00 00 35 E4 62 00   ../&x.....j.kj.........'@........5.b.
0280:  15 E4 86 00 29 67 B2 00 1A 09 FF 00 38 BB F6 4C 2C 00 01 00 54 54 54 00 91 00 00 00 00 00 00 00   ....)g......8..L,....T..............
02A0:  00 0B 03 C0 DF 1B 55 84 7C 91 34 FA 2E 90 74 00 04 00 04 00 27 11 97 00 21 00 02 62 5C 1E 1C 21   ......U.|.4....t.........'...!..b\...!
02C0:  3A 5E C6 26 5F CC 2A 07 19 EE 94 F8 59 13 3B 06 F7 02 51 07 6D 01 61 02 D0 01 52 00 0D 00 03 01   :^.&_.*.....y;...Q.m.a...R..........
02E0:  BF 00 4E 00 00 0E 29 00 00 00 18 00 18 00 00 2D 46 00 00 00 09 00 00 0A 00 00 00 00 1F 00 00 00   ..N...}........-F...................
0300:  98 00 01 00 00 03 36 00 00 00 08 00 08 C2 1A FF FF FF FF FF FF FF FF FF FF FF FF FF FF FF FF FF   ......6.............................
0320:  FF FF FF FF FF FF FF FF FF FF FF FF FF FF FF FF FF FF FF FF FF FF FF FF FF FF FF FF FF FF FF FF   ................................
0340:  FF FF FF FF FF FF FF FF FF FF FF FF FF FF FF FF FF FF FF FF FF FF FF FF FF FF FF FF FF FF FF FF   ................................
0360:  FF FF FF FF FF FF FF FF FF FF FF FF FF FF FF FF FF FF FF FF FF FF FF FF FF FF FF FF FF FF FF FF   ................................
0380:  FF FF FF FF FF FF FF FF FF FF FF FF FF FF FF FF FF FF FF FF FF FF FF FF FF FF FF FF FF FF FF FF   ................................
03A0:  FF FF FF FF FF FF FF FF FF FF FF FF FF FF FF FF FF FF FF FF FF FF FF FF FF FF FF FF FF FF FF FF   ................................
03C0:  FF FF FF FF FF FF FF FF FF FF FF FF FF FF FF FF FF FF FF FF FF FF FF FF FF FF FF FF FF FF FF FF   ................................
03E0:  FF FF FF FF FF FF FF FF FF FF FF FF FF FF FF FF FF FF FF FF FF FF FF FF FF FF FF FF FF FF FF FF   ................................

FW Revision: EF410097                    Serial Number: SG9B01300K0K

Pen 1 Vertical Alignment:     0
Pen 1 Horizontal Alignment:  -12

Pen 0 Bidir Adjust: 39
Pen 1 Bidir Adjust: 33

OTOE:    11000
Zero Column:    8380

LEDB:    27
COUNTS: 484, 2
FOV:     25

Pen Diagnostic Type: 1
                Data 1: 1
            Data 2: 2
            Data 3: 4
            Data 4: 0
```

Figure 2

PRINTER AND METHOD FOR EXECUTING A PRINT JOB AND STORING PRINT USAGE INFORMATION

BACKGROUND OF THE INVENTION

This invention relates to a printer and a method for executing a print job and storing print usage information.

For a printer manufacturer, it is very difficult to collect information about the usage of a printer in general, in particular to collect information about the user who requests a print job and the application which requests a print job.

This kind of information, however, is crucially important for the manufacturer in order to design printers that meet with users' needs.

Collecting information about the usage of a device such as conducting market surveys and interviews is time-consuming and expensive. Furthermore, the collected data may not be accurate, since they do not necessarily need to describe the actual usage activities of a user of a printer.

Furthermore, it is known from the HP DeskJet® Printer software, that a user can activate computer-based tracking of the print usage information by using a separate installed print usage-monitoring tool, if the user participates in a market survey conducted by Hewlett-Packard Company. When being installed, the usage-monitoring tool activates a special print usage-monitoring driver which generates a protocol file (log file) on the user's computer. In this protocol file, the computer stores user information and application information, in general, print usage information.

This approach has the following inherent disadvantages:

A performance penalty is imposed in accessing the protocol file during the printing process and hence, the user's consent is needed to activate the print usage-monitoring driver setting.

The print usage-monitoring driver does not collect the information for a group of users in a single location. Thus, the recovery of data in general, in particular of the print usage information, becomes rather difficult. The difficulties especially lie in the field of getting all users to activate the special setting of the print usage-monitoring drivers, identifying whether all users are printing to the same printer, and collecting the protocol files, which are stored in each user's computers.

Furthermore, a separate software tool has to be installed on each user's computer in order to activate the generation of the protocol file and the recovery process.

SUMMARY OF THE INVENTION

It is thus an object of the present invention to provide a printer and a method for executing a print job and storing print usage information, with which an easier collection of print usage information is achieved.

The object is met with a printer and a method for executing a print job and storing print usage information with features according to the independent claims.

According to a first aspect of the present invention, a printer has a memory unit for storage of print usage information pertaining to at least one print job a period after the print job has been finished, wherein the print usage information characterizes the print job.

Furthermore, the memory unit temporarily stores print control information substantially during the execution of the print job, wherein the print control information is used to control the print job.

In contrast to the temporary storing of the print control information, the print usage information is stored not only substantially during the execution of the respective print job, but even for a period of time after the print job has even been finished. The print control information is only needed for the print job itself, whereas the print usage information is needed for a subsequent analysis of the usage of the respective printer. In other words, the print usage information is stored for a period of time even after the print job has been finished and the print control information has already been deleted.

In the context of this application, information about the usage of a printer (the print usage information) may include:

- the number of users who send print jobs to a printer;
- the number of print jobs sent by each user;
- the names of applications used to generate print jobs sent to a printer;
- the number of pages printed by each application.

However, it should be noted that the invention can be extended to collect other types of print usage information, in particular to collect other types of user information and/or application information.

The print control information may include control characters for controlling the printing process and the characters which are to be printed.

According to a second aspect of the present invention, a method for executing a print job and storing print usage information, includes the step of generating a print request by an application, which application is executed by a computer. The print request includes print control information and print usage information, wherein the print control information is used to control the print job, and wherein the print usage information characterizes the print job. In a further step, the print request is sent to a printer which is connected to the computer. After the printer has received the print request, the printer executes the print job which is requested in the print request according to the print information included in the print request. Furthermore, the print usage information included in the print request is stored, preferably a period of time after the print job has been finished, in a memory unit of the printer.

The central storage of the print usage information in the printer in particular has the advantage of an easy analysis of the users' behavior and activities.

Further advantages of the present invention may be seen as follows:

The invention works regardless of whether the printer is a local printer used by a single user, or a network printer used by a group of users. In the case of a network printer, the information collected is the total sum for all users who print to the network printer.

By storing the print usage information centrally in the printer's memory instead of storing the print usage information noncentrally on each of a user's computer, the print usage information can be recovered by a person, for example by a manufacturer of the printer, very easily by generating a printer diagnostic page, or by querying the printer for the print usage information using a software tool. The printer diagnostic page may be sent to the printer manufacturer via facsimile.

Furthermore, the invention works transparently and does not require the user to install any additional software tool, in particular the installation of any print usage-monitoring tool.

BRIEF DESCRIPTION OF THE DRAWINGS

FIG. 2 shows the printout of contents stored in a non-volatile-memory.

DESCRIPTION OF THE PREFERRED EMBODIMENT

Figure 1:
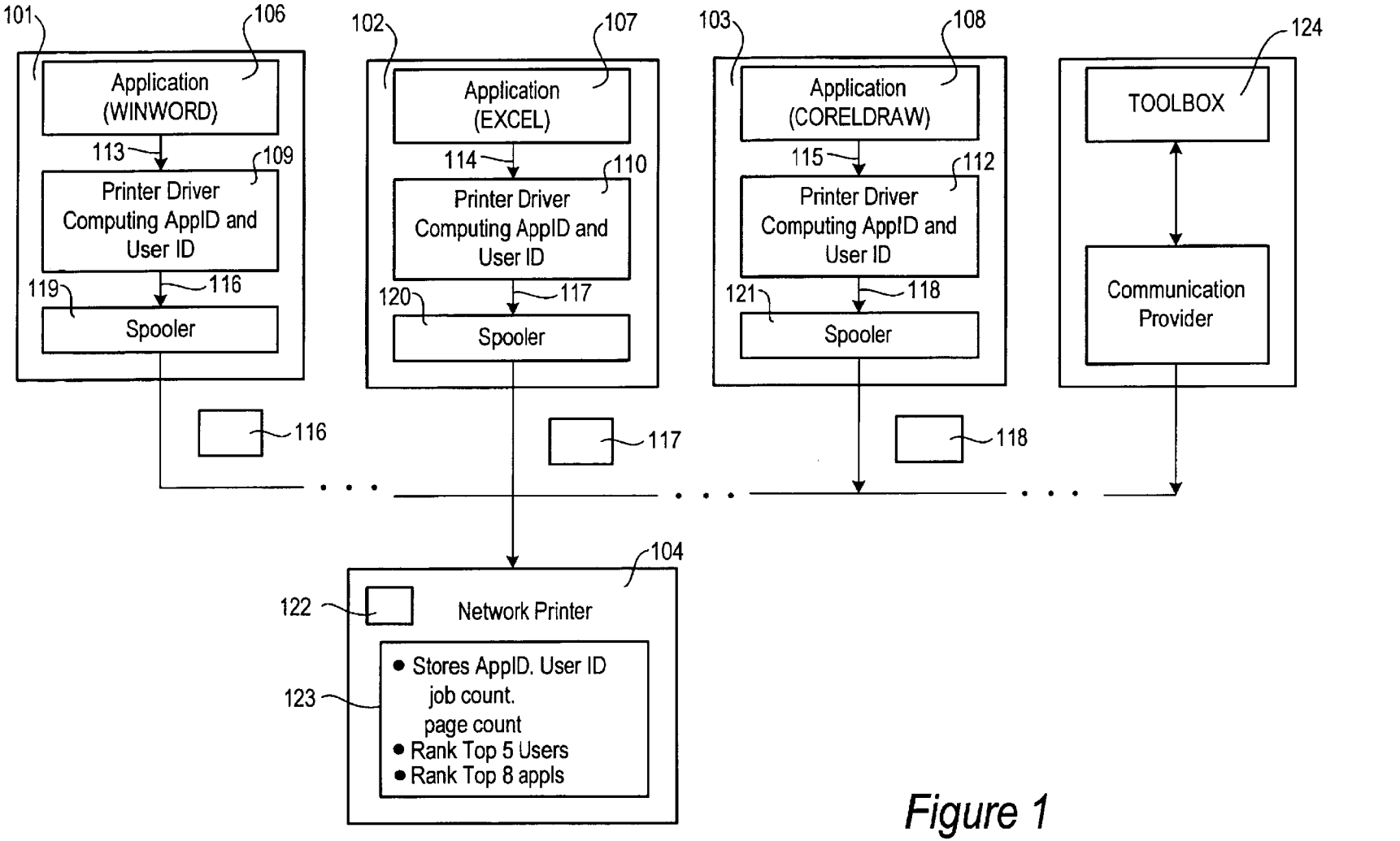
FIG. 1 is a block diagram of the computer system comprising a plurality of computers and a printer according to a preferred embodiment of the invention.

A preferred embodiment of this invention and modifications thereof will now be described with reference to the accompanying drawings.

FIG. 1 shows a computer system 100 having a plurality of computers 101, 102, 103 and a network printer 104. One of the computers 101, 102, or 103 is named after, for example, "HPSGDNT1."

The computers 101, 102, 103 and the network printer 104 are connected to each other over a local area network 105 thus constituting a computer network.

Each computer 101, 102, 103 has at least:

a) a central processing unit (CPU), b) a storage device, c) a computer bus and d) an input-/output-interface.

The respective central processing unit, storage device and input-/output-interface are connected with said bus for exchanging electrical signals.

Each computer 101, 102, 103 may further have a display and/or input device such as a keyboard, a computer mouse, etc. (not shown).

Each of the computers 101, 102, 103 is running the operating system Microsoft® Windows 95® or later.

Furthermore, different or the same applications are installed on the different computers 101, 102, 103.

According to this preferred embodiment, just for the purpose of simplicity, the program Microsoft Winword® 106 is installed on the first computer 101, the program Microsoft Excel® 107 is installed on the second computer 102, and the program Coreldraw® 108 is installed on the third computer 103.

Furthermore, a printer driver 109, 110, 111 is installed on each computer 101, 102, 103.

As shown in FIG. 1, when a user prints from an application 106, 107, 108, the application 106, 107, 108 generates information 113, 114, 115 which should be printed by the printer 104 comprising for example the content of the file loaded into the application 106, 107, 108. The information 113, 114, 115 may include textual information, graphic objects, formula objects, pictures, etc.

The information 113, 114, 115 is provided to the printer driver 109, 110, 111 of the respective computer 101, 102, 103.

The printer driver 109, 110, 111 computes, after the receipt of the information 113, 114, 115 to be printed, a user identification number (further denoted as UserID) and an application identification number (further denoted as ApplID) as part of print usage information, which IDs will be described later in-detail.

Then, the printer driver 109, 110, 111 generates a print job 116, 117, 118, which includes the data to be printed by the printer 104.

Furthermore, the printer driver 109, 110, 111 generates the print usage information by composing data according to the format defined as follows:

@PJL USAGE<optionalwhitespace>= <optionalwhitespace>

<PrinterAbbreviation>,<UserID UINT16>,<ApplID UINT16>,

<FeatureByte>,<OS Byte>,<Port Byte><Terminator>

The print usage information is sent to the printer 104 as part of the print job 116, 117, 118.

The individual parameters of the print usage information have the following meaning:

@PJL USAGE is a descriptor which denotes the start of the print usage information field;

<optionalwhitespace> means that there may be a blank ("white space") input at this position;

the field <PrinterAbbreviation> includes the name of the printer 114, which should execute the print job 116, 117, 118; this information is of particular importance when there is a plurality of printers provided in the computer network;

<UserID UINT16> is an unsigned 16-bit number that represents a user of the printer; according to this embodiment, the valid range is thus 0001 to FFFF (hexadecimal number); the printer driver 109, 110, 111 generates a UserID by computing a 16-bit checksum based on the name of the user's computer 101, 102, 103, (for example HPSGDNT1); in this context, it is assumed that each user has a unique computer name; the checksum may be computed simply by assigning each possible character of the used character set a value based on its position in the character set and then computing the total sum of the actually assigned values; it should be mentioned that any algorithm for generating a checksum as a 16-bit representation of a respective input string may be used in the present invention;

<ApplID UINT16> is an unsigned 16-bit number that describes the name of an application used to generate a print job 116, 117, 118; according to this embodiment, the valid range is thus 0001 to FFFF (hexadecimal number); the printer driver 109, 110, 111 generates an ApplID by computing a 16-bit checksum based on the name of the application main executable file name; for example, if the user prints from Microsoft Winword® 106, the application executable name is WINWORD; in this context, it is assumed that the executable file names for most applications are unique; by running the printer driver 109, 110, 111 with a list of predetermined, for example popular, applications during the printer development test cycles, a database of ApplIDs versus application names can be generated; this list will be used to decode the application information retrieved from the printer's memory; the checksum may be computed simply by assigning each possible character of the used character set a value based on its position in the character set and then computing the total sum of the actually assigned values; it should be mentioned that any algorithm for generating a checksum as a 16-bit representation of a respective input string may be used in the present invention;

<FeatureByte> is an unsigned 8-bit number that represents the printer feature(s), for example "ZoomSmart", "Handout", "Tiling", "Duplex", "Booklet", "Mirror", "Banner", or any other features not described above, selected by the user for the print job 116, 117, 118;

<OS Byte> denotes the operating system used by the respective computer 101, 102, 103;

<Port Byte> denotes the type of printer port or network connection used by the computer 101, 102, 103, to transmit the print job 116, 117, 118 to the printer;

<Terminator> is a unique identifier that denotes the end of the print usage information field.

When the printer driver 109, 110, 111 executes, it finds out information about the environment it operates in, for example, <UserID>, <OS Byte>, and <Port Byte>, as well as information about the print job, for example, <AppID>, <FeatureByte>, 116, 117, 118. This information can be obtained at run time by calling standard Windows APIs.

In addition, some information such as the <Printer Abbreviation> is compiled into the driver code because the printer driver 109, 110, 111 has to know which printer model it supports.

The print jobs 116, 117, 118 are provided to a spooler 119, 120, 121, one of which is provided in each computer 101, 102, 103.

The Windows® spooler is the component of the Windows printing subsystem that enables print jobs 116, 117, 118 to be routed to local and network printers 104. The spooler's responsibilities include:

Retrieving the location of the correct printer driver and loading it.

Accepting a data stream prepared by a printer driver for output on a particular type of printer.

Spooling the data to a file if the printer is not available to print it.

Delivering data to the printers 104 for printing, either directly or by playing back spooled files.

The spooler 119, 120, 121 thus controls the transmission of the print jobs 116, 117, 118 from the computer 101, 102, 103 to the printer 104.

The printer 104 has an input-/output-interface (not shown), a processor (not shown), and a memory unit 122, preferably, a non-volatile memory.

Furthermore, the printer 104 includes firmware 123 which will now be described in detail.

The memory unit 122 stores print control information substantially during the execution of a print job, wherein the print control information is used to control the print job. The print control information may include control characters for controlling the printing process and the characters which are to be printed.

The memory unit also stores the print job temporarily.

Furthermore, the non-volatile memory 122 is used to store the print usage information, in particular the user information and application information as illustrated in the following table.

| Counter | Size of each counter (bytes) | Range |
|---|---|---|
| 5 user-id-counter | 2 | [0001, FFFF] |
| 1 scratch-user-id-counter | 2 | [0001, FFFF] |
| 5 user-id-job-counter | 2 | [0001, 65535] |
| 1 scratch-user-id-job-counter | 2 | [0001, 65535] |
| 8 app-id-counter | 2 | [0001, FFFF] |
| 1 scratch-app-id-counter | 2 | [0001, FFFF] |
| 8 app-id-page-counter | 2 | [0001, 65535] |
| 1 scratch-app-id-page-counter | 2 | [0001, 65535] |

Five pairs of UserID counters including user-id-counter and user-id-job-counter are used to store the five most frequent UserIDs and their corresponding job counts respectively. In the context of the application, when a print job is executed by the printer for a specific user which is identified by a UserID stored in a user-id-counter, the relative job count which is stored in the corresponding user-id-job-counter is incremented, preferably by the value "1." Therefore, the user-id-job-counter counts the number of print jobs executed by the printer for a specific user.

Eight pairs of ApplID counters including app-id-counter and app-id-page-counter are used to store the eight most frequent ApplIDs and their corresponding page counts respectively. In the context of the application, when a print job is executed by the printer for a specific application which is identified by an ApplID stored in a app-id-counter, the relative page count which is stored in the corresponding app-id-page-counter is incremented, preferably by the number of pages printed. Therefore, the app-id-page-counter counts the number of pages executed by the printer for a specific application.

In a preferred embodiment of the invention, for example, in the case of the HP® DeskJet® 1220C Printer, a print job which is sent from the printer driver to the printer has the following format:

```
(<ESC>%-12345X@PJL JOB NAME="<job name>"
@PJL
USAGE<optionalwhitespace>=<optionalwhitespace><Printer
Abbreviation>,<UserID UINT16>,<AppID UINT16>,<Feature
Byte>,<OS Byte>,<Port Byte><Terminator>
<Print Commands and Print Data for page 1>
<FF>
<Print Commands and Print Data for page 2>
<FF>
. . .
(<ESC>%-12345X @PJL EOJ<LF>
```

The printer differentiates the start of a print job and end of such a print job from the parameters of (<ESC>%-12345× and (<ESC>%-12345@PJL EOJ<LF> embedded in the print job. The printer also differentiates the end of a page in a print job from the <FF> command embedded in the print job. In this way, the printer calculates the number of pages printed at the end of the print job.

There is further provided a pair of temporary UserID counters including scratch-user-id-counter and scratch-user-id-job-counter and a pair of temporary ApplID counters including scratch-app-id-counter and scratch-app-id-page-counter as buffer counters, which will be described later in detail with respect to the description of the algorithm. The temporary UserID counters, particularly the scratch-user-job-counters, are used to count the number of current print jobs consecutively requested from one user, while the temporary ApplID counters, particularly the scratch-app-id-page-counters, are used to count the number of printed pages consecutively requested from one application The values of all counters are initialized to the value "0" when the printer is manufactured.

It should be noted that the number of the respective counters can be chosen entirely freely.

The following algorithm is used to track the five most frequent users:

A1) Update Counters

If the received UserID is a new UserID, that is, the received UserID has not been stored in any of the user-id-counters or the scratch-user-id-counter, and if there is an empty pair of UserID counters or temporary UserID counters, the empty user-id-counter or scratch-user-id-counter is used to store the new UserID and the job count for such a new UserId, i.e., the value of the corresponding user-id-job-counter or scratch-user-id-job-counter, is set to the value "1."

If the received UserID is an existing UserID,that is, the UserID has been stored in one of the user-id-counters or the scratch-user-id-counter, the job count for such an existing UserID, i.e., the value of the corresponding user-id-job-counter or scratch-use-id-job-counter, is incremented, preferably by the value "1".

If the scratch UserID is updated, i.e., the value of the scratch-user-id-job-counter is incremented, the steps of the procedure "Search and Replace" (A2) are executed as described in the following.

A2) Search and Replace

The lowest job count is searched among the user-id-job-counters.

If the value of the scratch-user-id-job-counter exceeds the lowest job count, the values in the user-id-counter and user-id-job-counter of the lowest job count are replaced by the values in the scratch-user-id-counter and scratch-user-id-job-counter respectively. Further, the scratch-user-id-counter and scratch-user-id-job-counter are cleared.

Thus, if the value of the scratch-user-id-job-counter is persistently lower than the values of the other five user-id-job-counters, UserIDs other than these six would not be tracked.

The following algorithm is used to track the eight most frequent applications:

B1) Update Counters

If the received ApplID is a new ApplID and there is an empty app-id-counter or scratch-app-id-counter, the empty app-id-counter or scatch-app-id-counter is used to store the new ApplID and the page count for the ApplID, i.e., the value of the corresponding app-id-page-counter or scratch-app-id-page-counter is set to the value "1".

If the received ApplID is an existing ApplID, the page count for the respective ApplID is incremented, preferably by the number of printed pages.

If the scratch-app-id-page-counter is updated, the steps of the procedure "Search and Replace" (B2) are executed as described in the following.

B2) Search and Replace

The lowest page count is searched among the app-id-page-counters.

If the value of the scratch-app-id-page-counter exceeds the lowest page count, the values in the app-id-counter and app-id-page-counter of the lowest page count are replaced by the values in the scratch-app-id-counter and scratch-app-id-page-counter respectively. Further, the scratch-app-id-counter and scratch-app-id-page-counter are cleared.

Thus, if the value of the scratch-app-page-counter is persistently lower than the other eight app-id-page-counters, ApplIDs other than these nine would not be tracked.

In this context, it should be noted that a print job may include the request to print a plurality of pages.

Hence, it is possible that an application 106, 107, 108 can top the ranking of the counters with a single print job that consists of many pages.

Furthermore, the firmware 122 allows retrieval of the information collected such as ApplID, UserID, page counts, and job counts via a PRINTER-USAGE-MONITORING-DATA PML object.

PML (Peripheral Management Language) is an object oriented request-reply printer management nt protocol used in Hewlett Packard® printers. PML allows an application running on a host computer to control the printer and receive information from it. The PML system model comprises:

A host computer with an application and a communication provider,

An input/output channel connecting the host computer and the printer,

A printer with a PML service and a communication provider.

A printer which supports the PML protocol organizes its device information in a list of PML objects. Each PML object is responsible for holding a piece of device information, for example, the PRINTER-USAGE-MONITORING-DATA object holds print usage information (which includes the application and User IDs). An application running on the host computer can retrieve the print usage information by querying the PRINTER-USAGE-MONITORING-DATA object. The application communicates with the printer via a bi-directional link using standard protocols such as PML, MLC, IEEE 1284, USB or network protocols.

In the case of the HP® DeskJet® 1220C Printer, the application is the Toolbox 124. printer utility, which may be considered as a part of the printer driver. The Toolbox 124 can be implemented on any of the host computers 101, 102, 103 or on a further computer (not shown) which is connected to the printer. The Toolbox 124 establishes bi-directional communication with the printer and retrieves the print usage information by querying the PRINTER-USAGE-MONITORING-DATA object.

The contents of the non-volatile memory in the printer can be printed. In order to send the "print non-volatile memory contents" command to the printer, the printer's Power button has to be pressed. The Power button has to be pressed continuously and the Cancel button has to be tapped once. The Power button has to be pressed continuously and the Resume button has to be tapped twice. The printer then generates the Non-Volatile-Memory Content Page. The Power button, the Cancel button, and the Resume button are part of the printer's front panel.

A user can print and fax the Non-Volatile Memory Content Page which is shown in FIG. 2 to the printer manufacturer.

Alternatively, the printer 104 may send the contents of the non-volatile memory as a file electronically via a telecommunications network, for example via the Internet.

It should be noted that the printer 104 may send information to a computer 101, 102, 103 using any desired communication protocol.

The storage of the print usage information may be summarized as follows:

The print usage information is stored in the non-volatile memory. It is updated whenever the printer firmware receives a job with a valid update print usage information header from the driver except for the following case, which also explains why the non-volatile memory unit will not run out of memory.

The non-volatile memory required for the number of counters and the size of each counter are pre-allocated. A 16 bit counter is used to store application identification page counts according to the preferred embodiment of the invention. A 16 bit counter is used to store user identification job counts according to the preferred embodiment of the invention.

A 16 bit counter can hold a value from 0 to 65535. So when the counter reaches a value of 65535, the counter is no longer updated, the value of the counter remains unchanged at 65535. Thus, a maximum of 65535 application identification page counts and user identification job counts can be tracked according to the preferred embodiment of the invention.

The print usage information should remain in the non-volatile memory until the non-volatile memory fails.

What is claimed is:

1. A printer comprising a memory unit for storing print usage information about at least one print job for a period after the print job has been finished, wherein the print usage information includes user information and/or application information which characterize/characterizes the user or the application requesting the print job, wherein the user information and/or application information represents a basis for an analysis of the user's behavior.

2. The printer according to claim 1, wherein the memory unit also stores print control information during the execution of the print job, wherein the print control information is used to control the print job.

3. The printer according to claim 1, further comprising firmware controlling the execution of the print job and the storing of the print usage information about the print job.

4. The printer according to claim 1, wherein the memory unit for storing the print usage information is a non-volatile memory.

5. The printer according to claim 1, wherein the memory unit comprises first counters for storing at least a part of the print usage information, each first counter counting the number of print jobs which are executed by the printer for a specific user.

6. The printer according to claim 5, wherein a user identification number is assigned to each of the first counters, wherein the user identification number identifies the user who requested the respective print job.

7. The printer according to claim 5, further comprising a first buffer counter counting the number of current print jobs consecutively requested from one user.

8. The printer according to claim 7, wherein a user identification number is assigned to the first buffer counter, wherein the user identification number identifies the user who requests a current print job.

9. The printer according to claim 1, wherein the memory unit comprises second counters for storing at least a part of the print usage information, each second counter counting the number of pages which are printed by the printer for a specific application.

10. The printer according to claim 9, wherein an application identification number is assigned to each of the second counters, wherein the application identification number identifies the application which requested the respective print job.

11. The printer according to claim 9, further comprising a second buffer counter counting the number of printed pages consecutively requested from one application.

12. The printer according to claim 11, wherein an application identification number is assigned to the second buffer counter, wherein the application identification number identifies the application which requests a current print job.

13. A method for executing a print job and storing print usage information, comprising the following steps:

a) generating a print request by an application which is executed by a computer, the print request comprising print control information and print usage information, wherein the print control information is used to control the print job, and wherein the print usage information includes user information and/or application information which characterize/characterizes the user or the application requesting the print job, wherein the user information and/or application information represents a basis for an analysis of the user's behavior, b) sending the print request to a printer which is connected to the computer, c) executing the requested print according to the print information of the print request, and d) storing the print usage information of the print request in a memory unit of the printer.

14. The method according to claim 13, wherein firmware of the printer controls the execution of the print job and the storing of the print usage information of the print request.

15. The method according to claim 13, wherein the print usage information is stored in a non-volatile memory.

16. The method according to claim 13, wherein first counters are provided, each first counter counting the number of print jobs which are executed by the printer for a specific user.

17. The method according to claim 16, wherein a user identification number is assigned to each of the first counters, wherein the user identification number identifies the user who requested the respective print jobs.

18. The method according to claim 16, wherein a first buffer counter is provided counting the number of current print jobs consecutively requested from one user as at least a part of the print usage information.

19. The method according to claim 18, wherein a user identification number is assigned to the first buffer counter, wherein the user identification number identifies the user who requests a current print job.

20. The method according to claim 19, wherein the value of a first counter is updated with the value of the first buffer counter, if the value of the first buffer counter is larger than the value of the first counter.

21. The method according to claim 13, wherein second counters are provided, each second counter counting the number of pages which are printed by the printer for a specific application as at least a part of the print usage information.

22. The method according to claim 21, wherein an application identification number is assigned to each of the second counters, wherein the application identification number identifies the application which requested the respective print jobs.

23. The method according to claim 21, wherein a second buffer counter is provided counting the number of printed pages consecutively requested from one application.

24. The method according to claim 23, wherein an application identification number is assigned to the second buffer counter, wherein the application identification number identifies the application which requests a current print job.

25. The method according to claim 24, wherein the value of a second counter is updated with the value of the second buffer counter, if the value of the second buffer counter is larger than the value of the second counter.

* * * * *